US012297620B2

(12) United States Patent
Morikawa et al.

(10) Patent No.: US 12,297,620 B2
(45) Date of Patent: May 13, 2025

(54) WORK MACHINE

(71) Applicant: HITACHI CONSTRUCTION MACHINERY CO., LTD., Tokyo (JP)

(72) Inventors: Masatoshi Morikawa, Ushiku (JP); Shinji Nishikawa, Kasumigaura (JP); Hiroaki Tanaka, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 18/022,366

(22) PCT Filed: Nov. 11, 2021

(86) PCT No.: PCT/JP2021/041437
§ 371 (c)(1),
(2) Date: Feb. 21, 2023

(87) PCT Pub. No.: WO2022/201623
PCT Pub. Date: Sep. 29, 2022

(65) Prior Publication Data

US 2023/0366171 A1 Nov. 16, 2023

(30) Foreign Application Priority Data

Mar. 22, 2021 (JP) ..... 2021-047789

(51) Int. Cl.
*E02F 3/43* (2006.01)
*E02F 9/26* (2006.01)

(52) U.S. Cl.
CPC ..... *E02F 3/437* (2013.01); *E02F 9/262* (2013.01)

(58) Field of Classification Search
CPC ..... E02F 9/262; E02F 9/2033
See application file for complete search history.

(56) References Cited

U.S. PATENT DOCUMENTS

2016/0002882 A1* 1/2016 Kanari ..... E02F 9/2033 701/50
2021/0010236 A1* 1/2021 Nishi ..... E02F 9/2292

FOREIGN PATENT DOCUMENTS

JP 2009-228249 A 10/2009
WO 2015/037642 A1 3/2015
WO 2020/012609 A1 1/2020

OTHER PUBLICATIONS

International Search Report of PCT/JP2021/041437 dated Jan. 25, 2022.

(Continued)

*Primary Examiner* — Imran K Mustafa
(74) *Attorney, Agent, or Firm* — MATTINGLY & MALUR, PC

(57) ABSTRACT

An object of the present invention is to provide a work machine that is capable of flexibly setting an entry-prohibited area for a work device according to an operator's intention. To achieve this, a controller 40 sets, as a first position, the position of a work tool 8 that is located when a setting switch 33 is operated, and sets, as a second position, the position of the work tool 8 that is located when the setting switch 33 is operated after the setting of the first position. Further, the controller 40 sets, as a boundary surface of an entry-prohibited area, a plane 70 that passes through a first reference point A and a second reference point B and that is perpendicular to a ground contact surface of a lower track structure 1. The first reference point A is one of a plurality of reference points 8L and 8R on the work tool 8 located at the first position, the plurality of reference points 8L and 8R being preset on the work tool 8. The second reference point B is one of the plurality of reference points 8L and 8R on the work tool 8 located at the second position.

6 Claims, 10 Drawing Sheets

(56) References Cited

OTHER PUBLICATIONS

International Preliminary Report on Patentability received in corresponding International Application No. PCT/JP2021/041437 dated Oct. 5, 2023.

* cited by examiner

WORK MACHINE

TECHNICAL FIELD

The present invention relates to a work machine such as a hydraulic excavator and a hydraulic crane, and particularly to a method of setting an entry-prohibited area for the work machine.

BACKGROUND ART

Conventionally, a hydraulic excavator as a typical example of a work machine can efficiently perform complicated operations by simultaneously driving a plurality of front members such as a boom, an arm, and a bucket. On the other hand, the work efficiency is largely varied depending on operator's proficiency. In recent years, for the purpose of achieving both the finish of a face of slope and the work speed without depending on the operator's proficiency, there have been proposed a machine control in which a front implement is semi-automatically controlled at the time of excavation and an area limiting control in which a machine main body and the front implement are reduced in velocity when they come close to a target surface, thereby preventing contact with surrounding obstacles and deviation from a set area.

For example, Patent Document 1 discloses a technology as follows. Specifically, in the technology, an operator sets an avoidance area (entry-prohibited area) where the entry of a work device (front implement) is restricted, and in order for the machine main body (a lower track structure and an upper swing structure) or the work device not to enter the avoidance area, the operation of the upper swing structure or the work device is restricted according to a distance from a reference point preset at a claw tip position of a bucket to the avoidance area. In addition, in Patent Document 1, as a method of setting the avoidance area, two points on a space are designated by use of the reference point, which is preset at the claw tip position of the bucket, and a vertical plane passing through these two points is set as a boundary surface of the entry-prohibited area.

PRIOR ART DOCUMENT

Patent Document

Patent Document 1: PCT Patent Publication No. WO2020/012609

SUMMARY OF THE INVENTION

Problem to be Solved by the Invention

In Patent Document 1, two points on a space are designated by use of the reference point, which is preset at the center of the claw tip position of the bucket, and the vertical plane passing through these two points is computed as the boundary surface of the entry-prohibited area. For example, in order to prevent the work tool from colliding with a structure, it is necessary to set, as the entry-prohibited area, an area beyond a wall surface of the structure. In this case, it is desirable that the boundary surface of the entry-prohibited area be made to coincide with the wall surface. However, when the upper swing structure is not facing the wall surface, points on the wall surface cannot be designated by use of the point at the center of the claw tip position of the bucket. Hence, the boundary surface may be set at a position spaced from the wall surface or may be set such as to intersect the wall surface.

The present invention has been made in consideration of the above-described problem. Accordingly, it is an object of the present invention to provide a work machine that is capable of flexibly setting an entry-prohibited area for a work device according to an operator's intention.

Means for Solving the Problem

In order to achieve the above-described object, according to the present invention, there is provided a work machine including a lower track structure, an upper swing structure that is swingably mounted on the lower track structure, a work device that includes a work tool and that is attached to the upper swing structure rotatably in a vertical direction, a plurality of actuators that drive the work device, and a controller that controls operations of the plurality of actuators such that the work device does not enter an entry-prohibited area set in surroundings. The work machine includes a setting switch that sets the entry-prohibited area according to an operation made by an operator. The controller is configured to set, as a first position, a position of the work tool that is located when the setting switch is operated, and set, as a second position, a position of the work tool that is located when the setting switch is operated after the setting of the first position. Further, the controller is configured to set, as a boundary surface of the entry-prohibited area, a plane that passes through a first reference point and a second reference point and that is perpendicular to a ground contact surface of the lower track structure. The first reference point is one of a plurality of reference points on the work tool located at the first position, the plurality of reference points being preset on the work tool. The second reference point is one of the plurality of reference points on the work tool located at the second position.

According to the present invention configured as above, the reference points to be used to set the entry-prohibited area for the work device can be selected from a plurality of reference point preset on the work tool, whereby the entry-prohibited area for the work device can flexibly be set according to an operator's intention.

Advantages of the Invention

With the work machine according to the present invention, an entry-prohibited area can flexibly be set according to an operator's intention.

MODES FOR CARRYING OUT THE INVENTION

Figure 1:
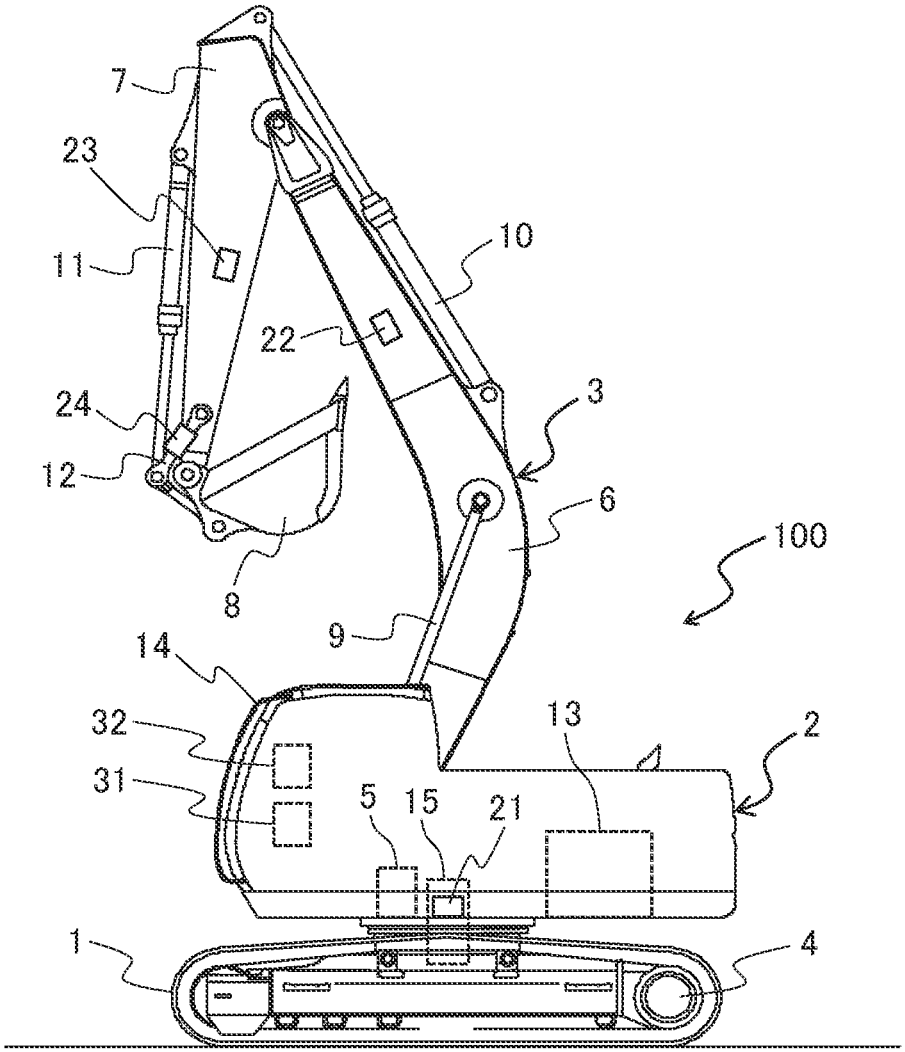
FIG. 1 is an appearance view of a hydraulic excavator according to a first embodiment of the present invention.

As an example of a work machine according to an embodiment of the present invention, a hydraulic excavator will be described below with reference to the drawings. Note that, in the drawings, equivalent members are denoted by the same reference characters, and overlapping descriptions thereof will be omitted as necessary.

Embodiment 1

FIG. 1 is an appearance view of a hydraulic excavator according to a first embodiment of the present invention. In FIG. 1, the hydraulic excavator, denoted by 100, includes a lower track structure 1, an upper swing structure 2 swingably mounted on the lower track structure 1, and a work device 3 attached to a front part of the upper swing structure 2 rotatably in the vertical direction. The lower track structure 1 is driven by left and right motors 4 (only the left motor is illustrated), and the upper swing structure 2 is driven by a swing motor 5.

The work device 3 has a boom 6 attached to the front part of the upper swing structure 2 rotatably in the vertical direction, an arm 7 attached to a tip part of the boom 6 rotatably in the vertical and front-rear directions, and a bucket 8 attached to a tip part of the arm 7 rotatably in the vertical and front-rear directions. The boom 6 is driven by a boom cylinder 9, the arm 7 is driven by an arm cylinder 10, and the bucket 8 is driven by a bucket cylinder 11. A tip of the bucket cylinder 11 is rotatably supported by the arm 7 and the bucket 8 through a bucket link 12.

A hydraulic system 13 for driving actuators 4, 5, and 9 to 11 is mounted on the upper swing structure 2. The hydraulic system 13 includes a prime mover, a hydraulic pump driven by the prime mover, control valves for controlling the flow rates of a hydraulic fluid to be supplied from the hydraulic pump to the actuators 4, 5, and 9 to 11, and the like. A cabin 14 in which an operator rides is provided on the left side of the front part of the upper swing structure 2.

An angle sensor 21 for sensing a relative angle (swing angle) of the upper swing structure 2 relative to the lower track structure 1 is incorporated in a center joint 15 provided between the lower track structure 1 and the upper swing structure 2. IMU (Inertial Measurement Unit) sensors 22 to 24 are attached to the boom 6, the arm 7, and the bucket link 12, respectively. The IMU sensors 22 to 24 are capable of measuring the angles of the boom 6, the arm 7, and the bucket 8 (the posture of the work device 3) from angular velocities of the boom 6, the arm 7, and the bucket link 12.

An operation device 31 for giving instructions on the operations of the upper swing structure 2 and the work device 3, a monitor 32 used for various settings (setting of an entry-prohibited area and other settings for machine main body) and for assistance in visibility, and a controller 40 (illustrated in FIG. 2) that controls the machine main body and performs control relating to a restriction on areas are provided in the cabin 14. The monitor 32 has a touch panel, and the operator can perform various settings by operating buttons and switches displayed on the monitor 32. The switches displayed on the monitor 32 include a setting switch 33 (depicted in FIG. 2) for informing the controller 40 that the positioning of the bucket 8 has been finished, and a selection switch 34 (depicted in FIG. 2) for selecting a reference point from among a plurality of reference points preset on the bucket 8. The reference point is used when an entry-prohibited area is set.

Figure 2:
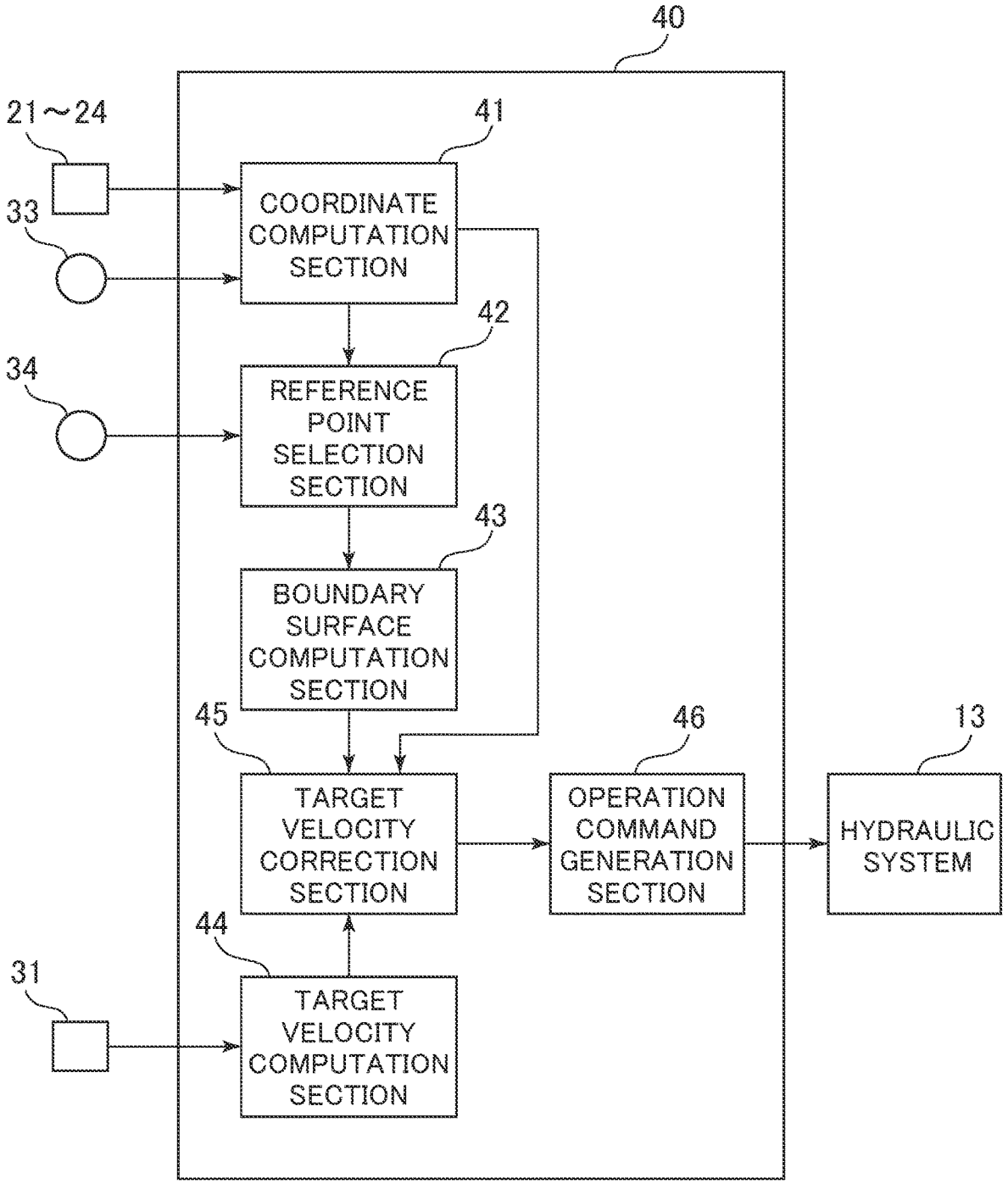
FIG. 2 is a functional block diagram of a controller according to the first embodiment of the present invention.

FIG. 2 is a functional block diagram of the controller 40. In FIG. 2, the controller 40 has a coordinate computation section 41, a reference point selection section 42, a boundary surface computation section 43, a target velocity computation section 44, a target velocity correction section 45, and an operation command generation section 46.

The coordinate computation section 41 computes coordinates of a reference point preset on the work device 3, based on the swing angle and the posture of the work device 3, and outputs the coordinates to the reference point selection section 42. The reference point here is set on the work device 3 at one or a plurality of positions that have possibility of being closest to an obstacle or a work target object. In addition, the coordinate computation section 41 computes the coordinates of reference points on the bucket 8 at the time when the setting switch 33 is operated, and outputs them to the reference point selection section 42. In the present embodiment, a first reference point is set at a bucket claw tip left end position 8L, and a second reference point is set at a bucket claw tip right end position 8R, but the number and the positions of the reference points are not limited to these.

The reference point selection section 42 sets the coordinates of the first reference point or the second reference point as a point (a first designated point or a second designated point)) on a boundary surface of the entry-prohibited area, according to an operation of the selection switch 34, and outputs them to the boundary surface computation section 43.

The boundary surface computation section 43 sets, as the boundary surface of the entry-prohibited area, a plane that passes through the first designated point and the second designated point and that is perpendicular to a ground contact surface of the lower track structure 1 (hereinafter, the plane is referred to as a perpendicular plane), and outputs it to the target velocity correction section 45.

The target velocity computation section 44 computes target velocities of the actuators 4, 5, and 9 to 11 based on an operation amount inputted from the operation device 31, and outputs them to the target velocity correction section 45.

The target velocity correction section 45 corrects the target velocities of the actuators 4, 5, and 9 to 11 in such a manner that the reference points preset on the work device 3 do not move beyond the boundary surface of the entry-prohibited area, and outputs the corrected target velocities to the operation command generation section 46.

The operation command generation section 46 generates operation commands according to the target velocities of the actuators 4, 5, and 9 to 11, and outputs them to the hydraulic system 13. As a result, the actuators 4, 5, and 9 to 11 are driven in such a manner that the work device 3 does not enter the entry-prohibited area.

Figure 3:
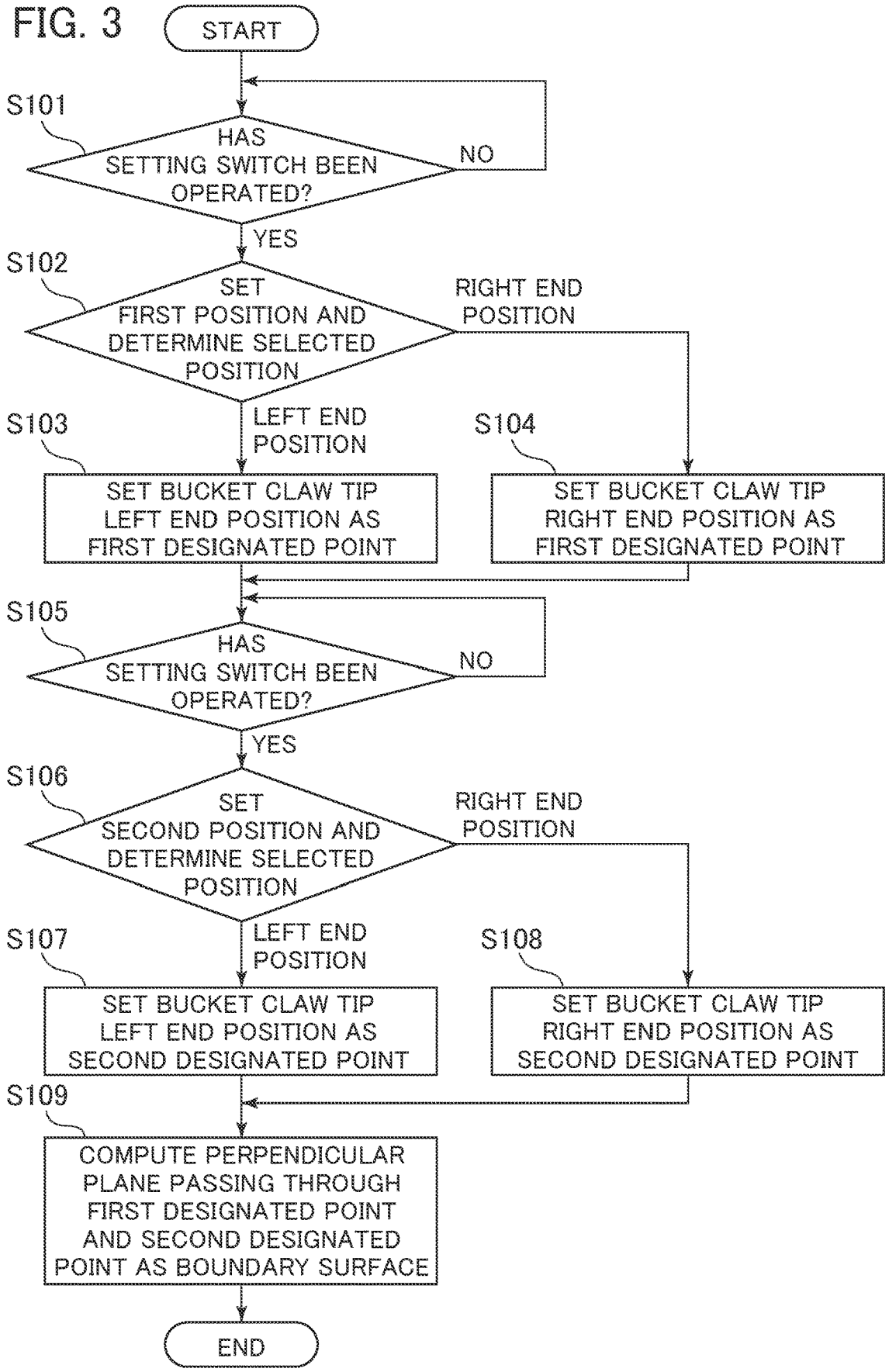
FIG. 3 is a flow chart depicting processing performed by the controller according to the first embodiment of the present invention.

FIG. 3 is a flow chart depicting processing performed by the controller 40. Steps of the processing will sequentially be described below.

The controller 40 first determines whether or not an operation of the setting switch 33 has been made (step S101). When a result of the determination in step S101 is NO, the processing returns to step S101.

When the result of the determination in step S101 is YES, the current position of the bucket 8 is set as a first position, and it is determined whether or not either the bucket claw tip left end position 8L (first reference point) or the bucket claw tip right end position 8R (second reference point) has been selected through the selection switch 34 (step S102). When the bucket claw tip left end position 8L has been selected, the bucket claw tip left end position 8L is set as a first designated point (step S103). When the bucket claw tip right end position 8R has been selected, on the other hand, the bucket claw tip right end position 8R is set as the first designated point (step S104).

Subsequent to step S103 or step S104, it is determined whether or not the setting switch 33 has been operated again (step S105). When a result of the determination in step S105 is NO, the processing returns to step S105.

When the result of the determination in step S105 is YES, the current position of the bucket 8 is set as a second position, and it is determined whether or not either the bucket claw tip left end position 8L or the bucket claw tip right end position 8R has been selected through the selection switch 34 (step S106). When the bucket claw tip left end position 8L has been selected, the bucket claw tip left end position 8L is set as a second designated point (step S107). When the bucket claw tip right end position 8R has been selected, on the other hand, the bucket claw tip right end position 8R is set as the second designated point (step S108).

Subsequent to step S107 or step S108, a perpendicular plane passing through the first designated point and the second designated point is computed as a boundary surface of the entry-prohibited area (step S109), and the flow is finished.

Here, problems arising in a method of setting the entry-prohibited area in the prior art will be described by using FIGS. 4 and 5. Note that, in the present embodiment, a case where an area beyond a wall surface of a structure is set as the entry-prohibited area in order to prevent the work device 3 from colliding with the structure will be described.

Figure 4:
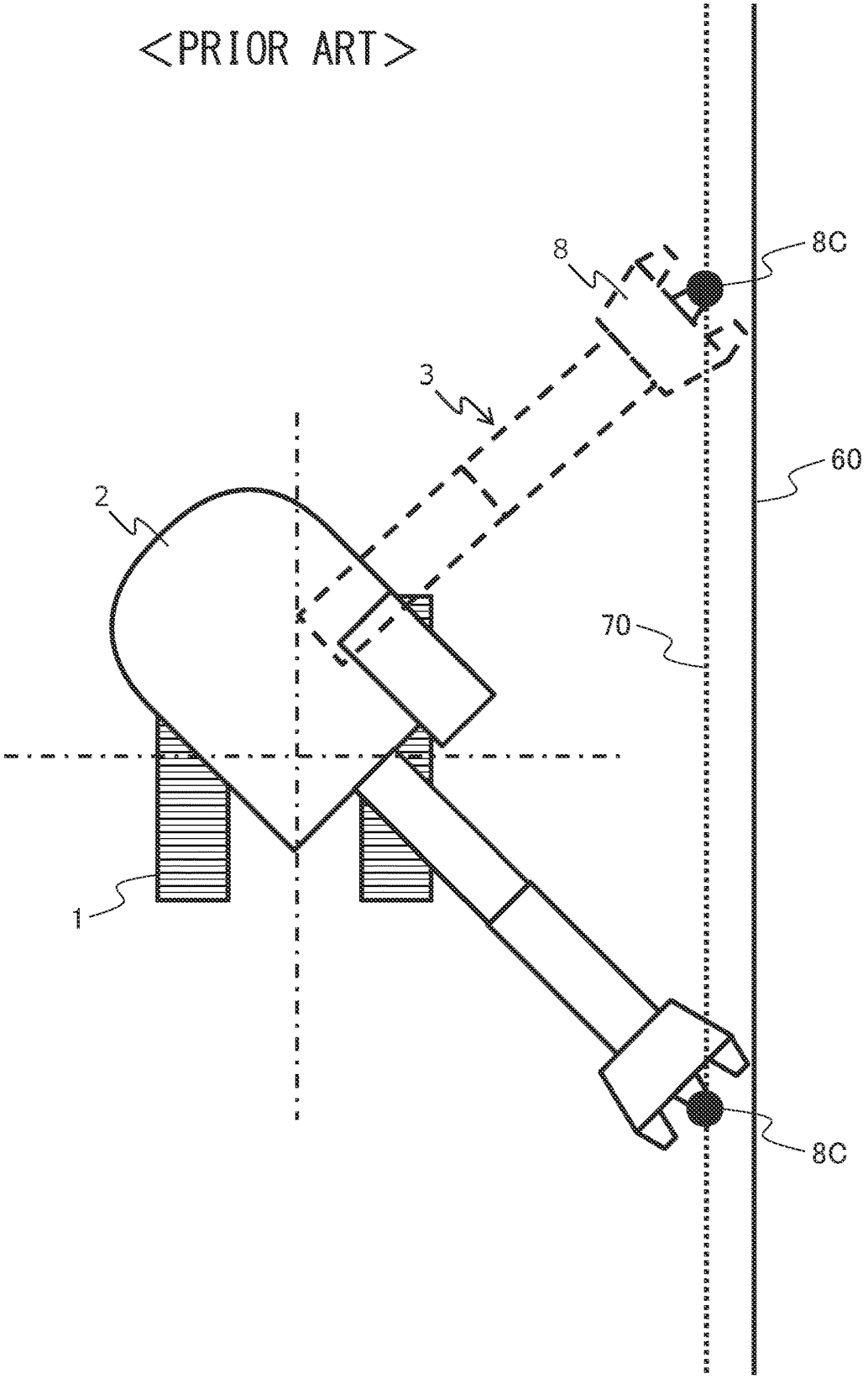
FIG. 4 is a diagram depicting an operation (No. 1) of a work machine at the time of setting an entry-prohibited area in the prior art.
Figure 5:
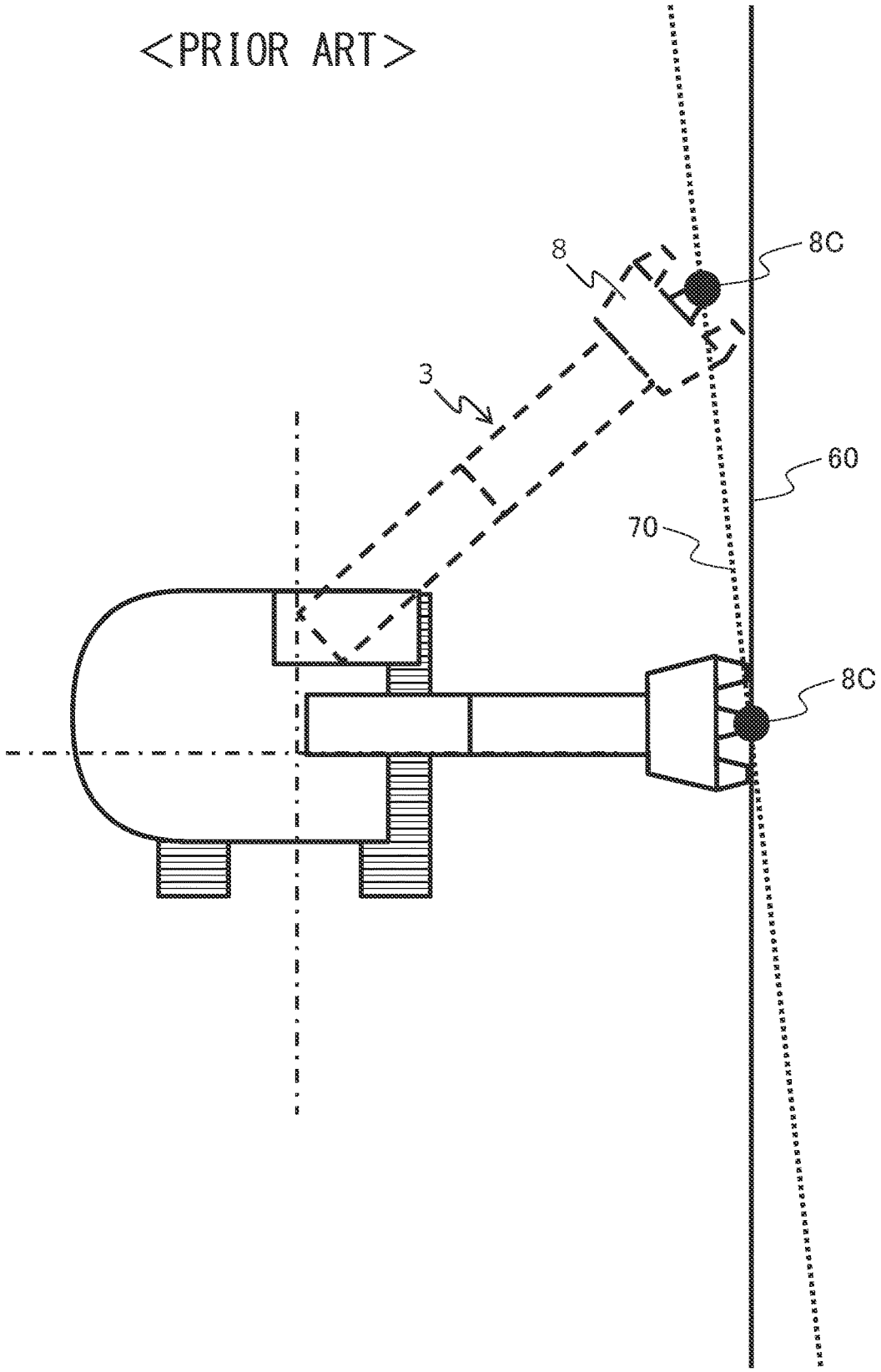
FIG. 5 is a diagram depicting an operation (No. 2) of the work machine at the time of setting the entry-prohibited area in the prior art.

In the example depicted in FIGS. 4 and 5, two points on a space are designated by use of the reference point preset at a bucket claw tip center position 8C, and a perpendicular plane 70 passing through these two points is computed as a boundary surface of the entry-prohibited area. However, when the upper swing structure 2 is not facing a wall surface 60, a point on the wall surface 60 cannot be designated by use of the bucket claw tip center position 8C. Hence, the boundary surface 70 may be set at a position spaced from the wall surface 60 as depicted in FIG. 4, or may be set such as to intersect the wall surface 60 as depicted in FIG. 5.

Figure 6:
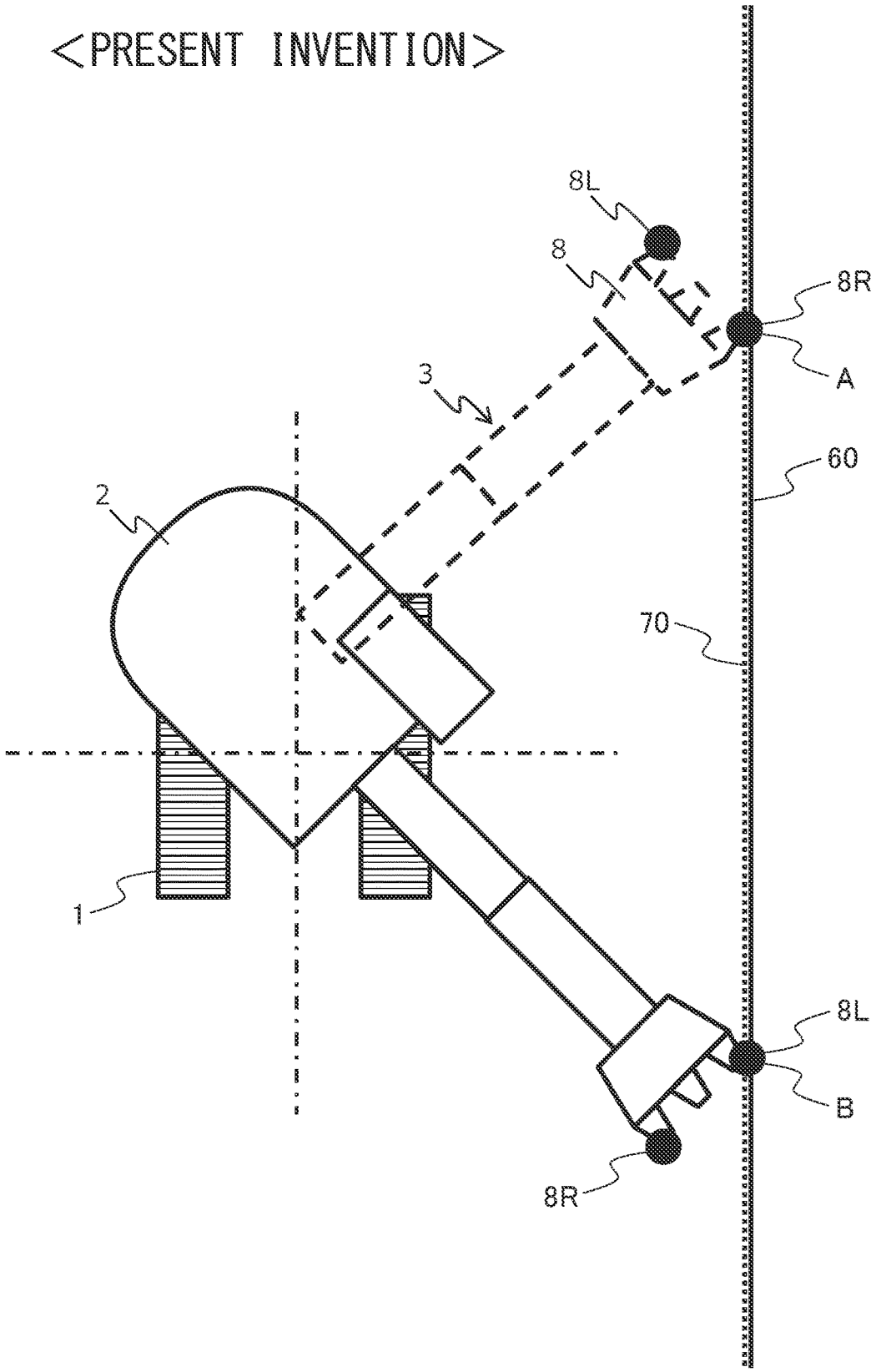
FIG. 6 is a diagram depicting an operation of a work machine at the time of setting an entry-prohibited area in the first embodiment of the present invention.

Next, the operation procedure that the operator goes through at the time of setting the entry-prohibited area in the present embodiment will be described by using FIG. 6.

Operation 1: positioning of the bucket 8 is conducted. Specifically, the bucket claw tip left end position 8L or the bucket claw tip right end position 8R is brought into contact with the wall surface 60. In the example depicted in FIG. 4, the bucket claw tip right end position 8R (second reference point) is positioned at a point A on the wall surface 60.

Operation 2: when the positioning of the bucket 8 is finished, the bucket claw tip right end position 8R (second reference point) in contact with the wall surface 60 is selected through the selection switch 34, and the setting switch 33 is operated. As a result, the current position of the bucket 8 is set as the first position, and the point A on the wall surface 60 is set as the first designated point.

Operation 3: positioning of the bucket 8 is again conducted. Specifically, the bucket claw tip left end position 8L or the bucket claw tip right end position 8R is brought into contact with the wall surface 60 at a position different from the first position. In the example depicted in FIG. 6, the bucket claw tip left end position 8L (first reference point) is positioned at a point B on the wall surface 60.

Operation 4: when the positioning of the bucket 8 is finished, the bucket claw tip right end position 8R (first reference point) in contact with the wall surface 60 is selected through the selection switch 34, and the setting switch 33 is operated. As a result, the current position of the bucket 8 is set as the second position, the point B on the wall surface 60 is set as the second designated point, and the perpendicular plane 70 passing through the first designated point A and the second designated point B is computed as a boundary surface of the entry-prohibited area.

SUMMARY

In the present embodiment, the work machine 100 includes the lower track structure 1, the upper swing structure 2 that is swingably mounted on the lower track structure 1, the work device 3 that includes the work tool 8 and that is attached to the upper swing structure 2 rotatably in the vertical direction, the plurality of actuators 4, 5, and 9 to 11 that drives the work device 3, and the controller 40 that controls operations of the plurality of actuators 4, 5, and 9 to 11 such that the work device 3 does not enter the entry-prohibited area set in the surroundings. The work machine 100 further includes the setting switch 33 that sets the entry-prohibited area according to an operation made by an operator. The controller 40 sets, as the first position, the position of the work tool 8 that is located when the setting switch 33 is operated, and sets, as the second position, the position of the work tool 8 that is located when the setting switch 33 is operated after the setting of the first position. Also, the controller 40 sets, as a boundary surface 70 of the entry-prohibited area, the plane 70 that passes through the first reference point A and the second reference point B and that is perpendicular to a ground contact surface of the lower track structure 1, the first reference point A being one of a plurality of reference points 8L and 8R on the work tool 8 located at the first position, the plurality of reference points 8L and 8R being preset on the work tool 8, the second reference point B being one of the plurality of reference points 8L and 8R on the work tool 8 located at the second position.

According to the present embodiment configured as above, the reference point to be used to set the entry-prohibited area for the work device 3 can be selected from the plurality of reference points 8L and 8R preset on the work tool 8, whereby the entry-prohibited area for the work device 3 can flexibly be set according to an operator's intention.

In addition, the work machine 100 in the present embodiment includes the selection switch 34 for selecting any one of the plurality of reference points 8L and 8R, and the controller 40 selects the first reference point A from among the plurality of reference points 8L and 8R when the work tool 8 is located at the first position, and selects the second reference point B from among the plurality of reference points 8L and 8R when the work tool 8 is located at the second position, according to an operation of the selection switch 34. As a result, the reference point to be used to set the entry-prohibited area can be selected from among the plurality of reference points 8L and 8R on the work tool 8 by the operator.

Moreover, the work tool 8 in the present embodiment is a bucket, and the plurality of reference points 8L and 8R include the point 8L located at the claw tip left end of the bucket 8 and the point 8R located at the claw tip right end of the bucket 8. As a result, in the work machine 100 including the bucket 8, the entry-prohibited area can flexibly be set according to an operator's intention.

Embodiment 2

A second embodiment of the present invention will be described focusing on the differences from the first embodiment.

Figure 7:
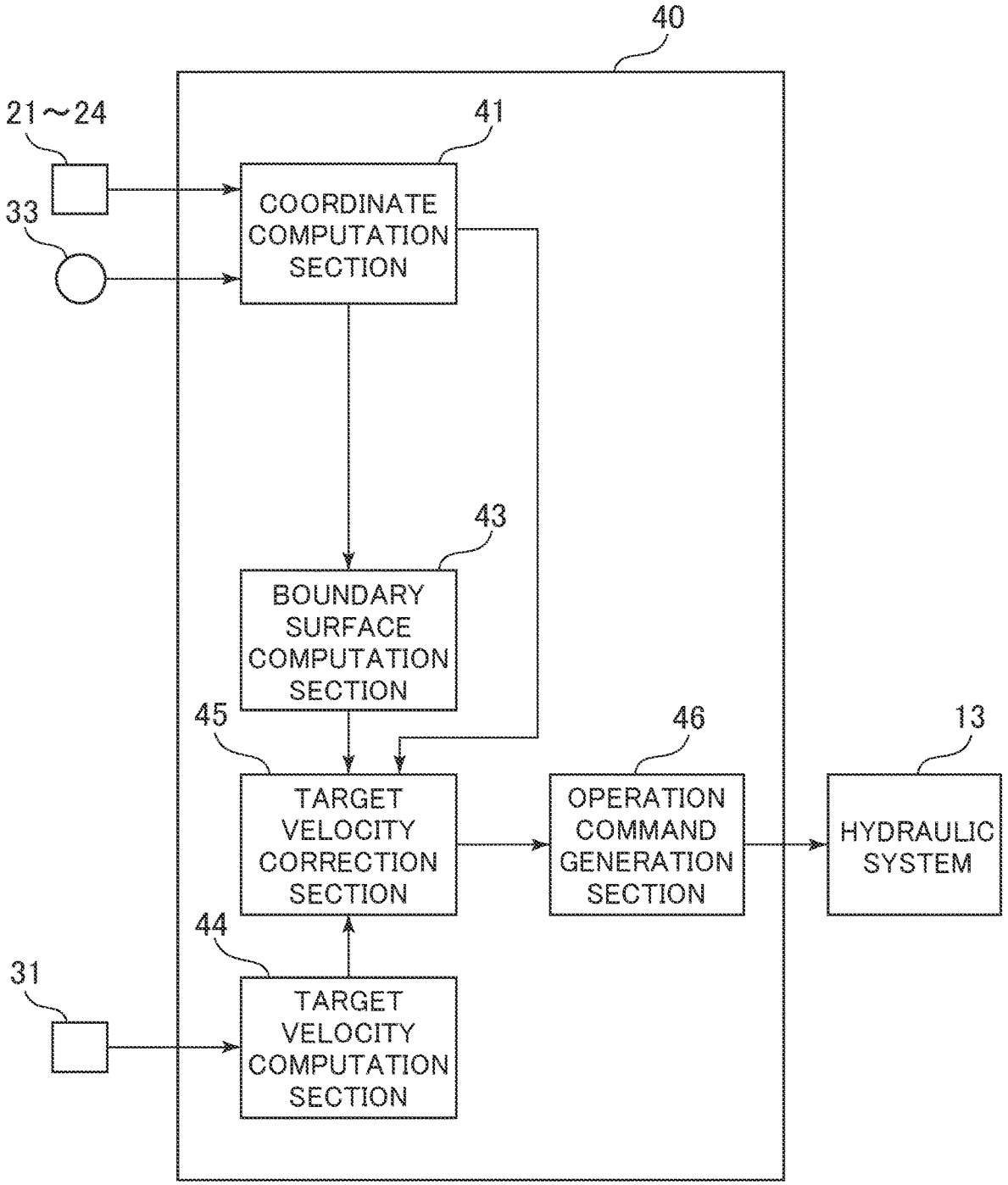
FIG. 7 is a functional block diagram of a controller according to a second embodiment of the present invention.

FIG. 7 is a functional block diagram of a controller 40 according to the present embodiment. In FIG. 7, the controller 40 does not have the reference point selection section 42 (depicted in FIG. 2) of the first embodiment. The coordinate computation section 41 computes the coordinates of the reference points 8L and 8R on the bucket 8 that are located when the setting switch 33 is operated, and outputs them to the boundary surface computation section 43.

Figure 8:
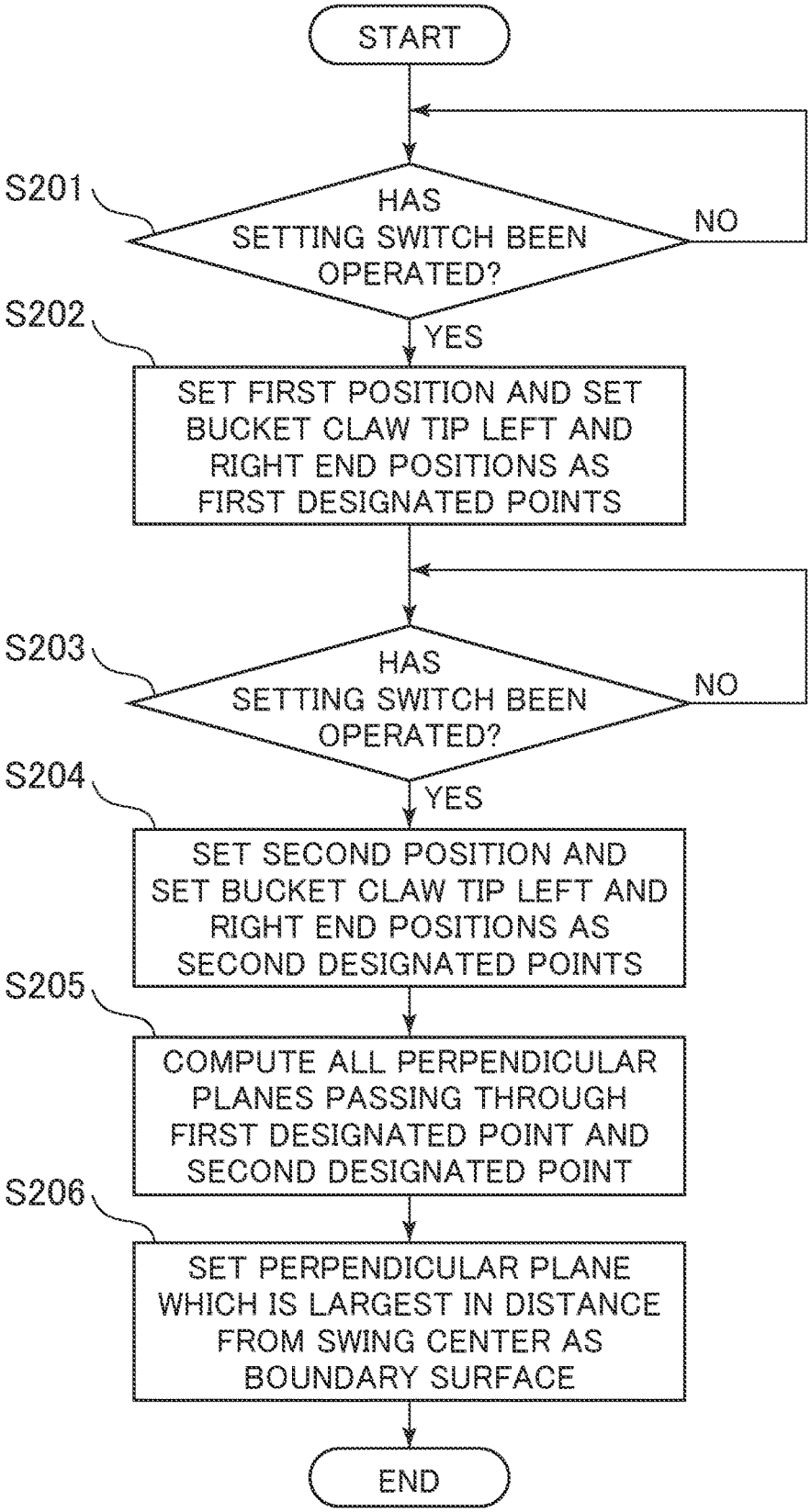
FIG. 8 is a flow chart depicting processing performed by the controller according to the second embodiment of the present invention.

FIG. 8 is a flow chart depicting processing performed by the controller 40 in the present embodiment. Steps of the processing will sequentially be described below.

The controller 40 first determines whether or not the setting switch 33 has been operated (step S201). When a result of the determination in step S201 is NO, the processing returns to step S201.

When the result of the determination in step S201 is YES, the current position of the bucket 8 is set as the first position, and the bucket claw tip left end position 8L and the bucket claw tip right end position 8R are set as first designated points (step S202).

Subsequent to step S202, it is determined whether or not the setting switch 33 has been operated again (step S203). When a result of the determination in step S203 is NO, the processing returns to step S202.

When the result of the determination in step S203 is YES, the current position of the bucket 8 is set as the second position, and the bucket claw tip left end position 8L and the bucket claw tip right end position 8R are set as second designated points (step S204).

Subsequent to step S204, all perpendicular plans passing through the first designated points and the second designated points are computed (step S205).

Subsequent to step S205, one of the plurality of perpendicular planes computed in step S205 which is the farthest plane from the swing center is set as a boundary surface of the entry-prohibited area (step S206), and the flow is finished. Note that, in the present embodiment, all the perpendicular planes passing through the first designated points and the second designated points are computed; however, all the perpendicular planes may not necessarily be computed since which perpendicular plane is the farthest plane from the swing center can be determined from the positional relation between the first designated point and the second designated point.

Figure 9:
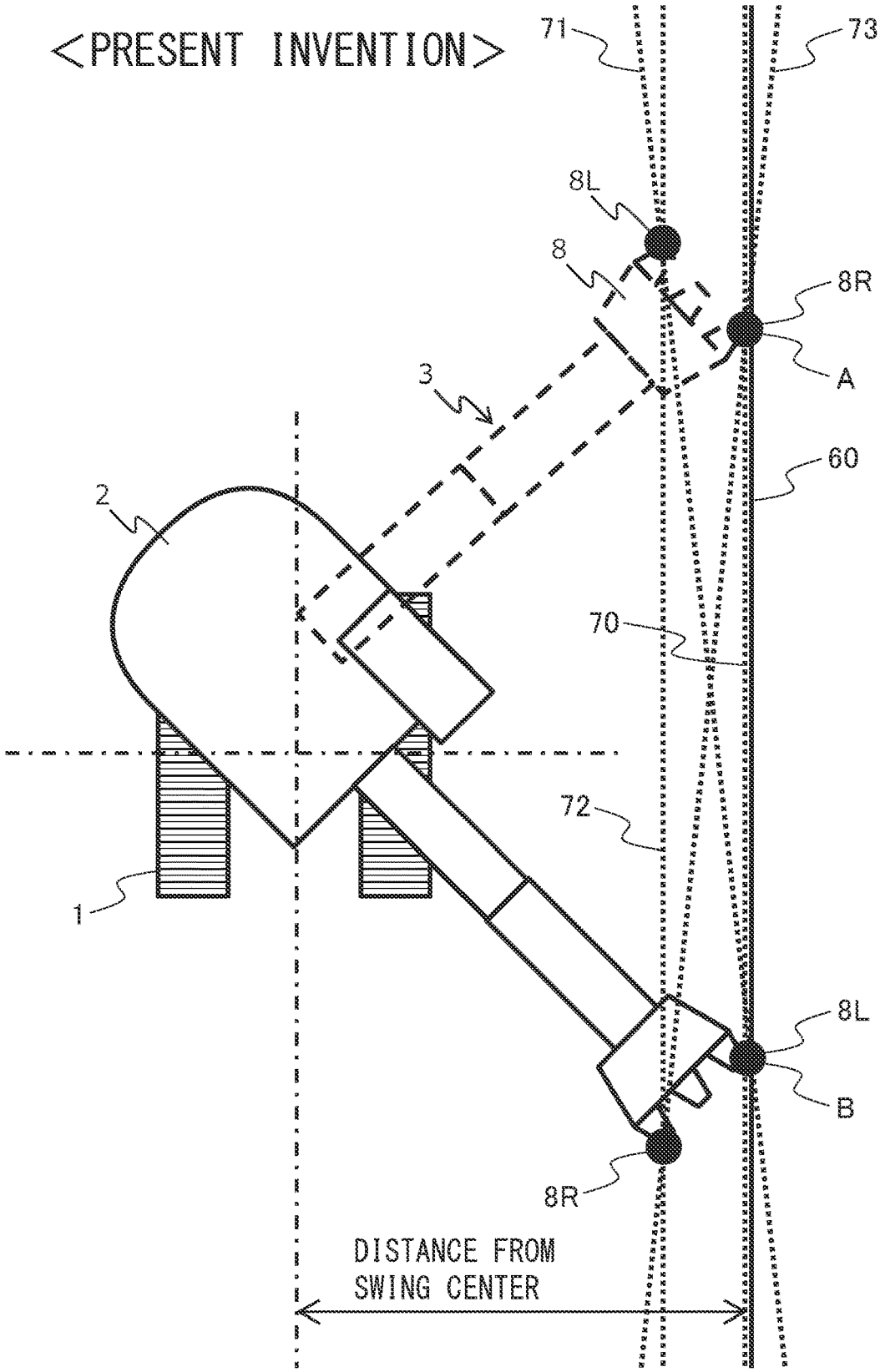
FIG. 9 is a diagram depicting an operation of a work machine at the time of setting an entry-prohibited area in the second embodiment of the present invention.

Now, the operation procedure that the operator goes through at the time of setting the entry-prohibited area in the present embodiment will be described by using FIG. 9.

Operation 1: positioning of the bucket 8 is conducted. Specifically, the bucket claw tip left end position 8L or the bucket claw tip right end position 8R is brought into contact with the wall surface 60. In the example depicted in FIG. 9, the bucket claw tip right end position 8R is located at a point A on the wall surface 60.

Operation 2: the setting switch 33 is operated. The current position of the bucket 8 is set as a first position.

Operation 3: positioning of the bucket 8 is conducted again. Specifically, the bucket claw tip left end position 8L or the bucket claw tip right end position 8R is brought into contact with the wall surface 60 at a position different from the first position. In the example depicted in FIG. 9, the bucket claw tip left end position 8L is located at a point B on the wall surface 60.

Operation 4: the setting switch 33 is operated. The current position of the bucket 8 is set as a second position. As a result, four perpendicular planes 70 to 73 each of which passes through one of the two reference points 8L and 8R (first designated points) on the bucket 8 located at the first position and one of the two reference points 8L and 8R (second designated points) on the bucket 8 located at the second position are computed. Then, of the four perpendicular planes 70 to 73, the perpendicular plane 70 which is the farthest plane from the swing center is set as a boundary surface of the entry-prohibited area.

SUMMARY

In the present embodiment, the first reference point and the second reference point are reference points located on the plane 70 that is the farthest plane from the swing center of the upper swing structure 2 among the plurality of planes 70 to 73 each of which passes, in a state of being perpendicular to the ground contact surface, through one of the plurality of reference points 8L and 8R on the work tool 8 located at the first position and one of the plurality of reference points 8L and 8R on the work tool 8 located at the second position.

In addition, the controller 40 in the present embodiment computes a plurality of planes 70 to 73 each of which passes through one of the plurality of reference points 8L and 8R on the work tool 8 located at the first position and one of the plurality of reference points 8L and 8R on the work tool 8 located at the second position and is perpendicular to the ground contact surface of the lower track structure 1. Then, the controller 40 sets, as a boundary surface of the entry-prohibited area, the plane 70 that is the farthest plane from the swing center of the upper swing structure 2 among the computed planes 70 to 73.

In the present embodiment configured as above, the entry-prohibited area can also be set flexibly according to an operator's intention as in the first embodiment. Further, the operator can set the entry-prohibited area more easily than in the first embodiment since it is unnecessary to select the reference points on the work tool 8 at the time of setting the first designated points and the second designated points.

Embodiment 3

A third embodiment of the present invention will be described focusing on the differences from the second embodiment.

In the first embodiment or the second embodiment, if the lower track structure moves during a period of time from the setting of the first designated point to the setting of the second designated point, a coordinate axis for use in computing the coordinates of the first designated point and a coordinate axis for use in computing the second designated point do not coincide with each other, so that there is a possibility that a boundary surface not intended by the operator may be set. The present embodiment solves this problem.

Figure 10:
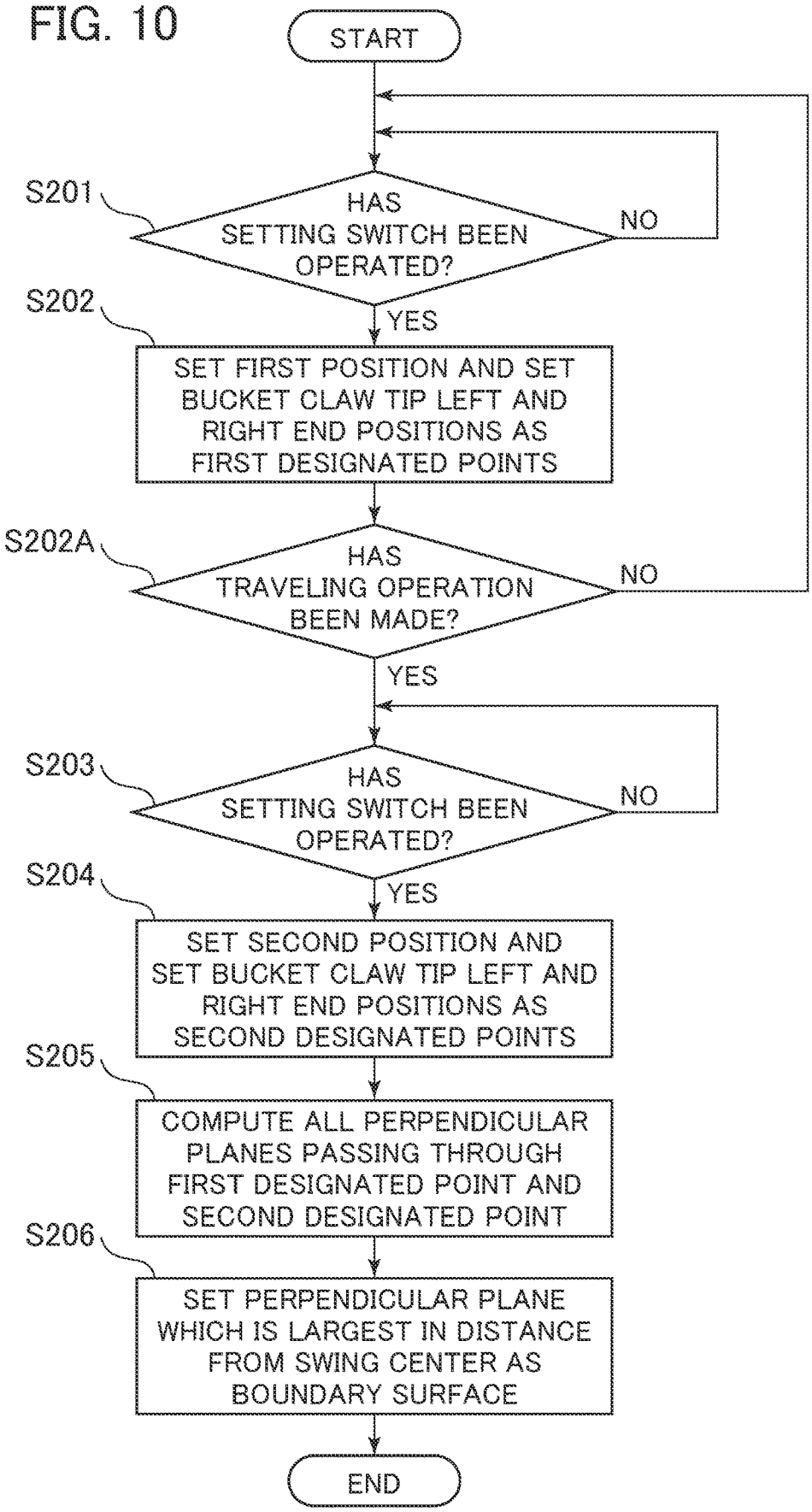
FIG. 10 is a flow chart depicting processing performed by a controller according to a third embodiment of the present invention.

FIG. 10 is a flow chart depicting processing performed by the controller 40 in the present embodiment. In the present embodiment, after step S202 is carried out, it is determined whether or not a travelling operation is made (step S202A). When a result of the determination in step S202A is YES, the processing returns to step S201. When the result of the determination is NO, on the other hand, the processing proceeds to step S203. As a result, when the lower track structure 1 travels during the period of time from the setting of the first position of the work tool 8 to the setting of the second position of the work tool 8, the setting of the first position is reset, so that the second designated point can be prevented from being computed according to a coordinate system different from the coordinate system used to compute the first designated point.

SUMMARY

The controller 40 in the present embodiment resets the setting of the first position when the lower track structure 1 travels during the period of time from the setting of the first position of the work tool 8 to the setting of the second position of the work tool 8.

According to the present embodiment configured as above, the second designated point can be prevented from being computed according to a coordinate system different from the coordinate system used to compute the first designated point, so that an improper entry-prohibited area can be prevented from being set.

While the embodiments of the present invention have been described in detail above, the present invention is not limited to the above-described embodiments and includes various modifications. For example, the above-described embodiments have been described in detail to facilitate the understanding of the present invention, and the present invention is not necessarily limited to the embodiment that includes all the described configurations. In addition, a part of the configuration of one embodiment can be added to the configuration of another embodiment. Also, a part of the configuration of one embodiment can be deleted or replaced with a part of another embodiment.

DESCRIPTION OF REFERENCE CHARACTERS

1: Lower track structure
2: Upper swing structure
3: Work device
4: Travel motor (actuator)
5: Swing motor (actuator)
6: Boom
7: Arm
8: Bucket (work tool)
9: Boom cylinder (actuator)
10: Arm cylinder (actuator)
11: Bucket cylinder (actuator)
12: Bucket link
13: Hydraulic system
14: Cabin
15: Center joint
21: Angle sensor
22 to 24: IMU sensor
31: Operation device
32: Monitor
33: Setting switch
34: Selection switch
40: Controller
41: Coordinate computation section
42: Reference point selection section
43: Boundary surface computation section
44: Target velocity computation section
45: Target velocity correction section
46: Operation command generation section
60: Wall surface
70: Perpendicular plane (boundary surface)
71 to 73: Perpendicular plane
100: Hydraulic excavator (work machine)

The invention claimed is:

1. A work machine comprising:
a lower track structure;
an upper swing structure that is swingably mounted on the lower track structure;
a work device that includes a bucket and that is attached to the upper swing structure rotatably in a vertical direction;
a plurality of actuators that drive the work device;
a sensor that measures a posture of the work device; and
a controller that controls operations of the plurality of actuators such that the work device does not enter a set entry-prohibited area; and
a setting switch that sets the entry-prohibited area according to an operation of an operator,
wherein the controller is configured to:
set, as a first position, a position of the bucket that is located computed based on the posture of the work device measured by the sensor when the setting switch is operated,
set, as a second position, a position of the bucket that is computed based on the posture of the work device measured by the sensor when the setting switch is operated after the setting of the first position, and
set, as a boundary surface of the entry-prohibited area, a plane that passes through a first reference point and a second reference point and that is perpendicular to a ground contact surface of the lower track structure, the first reference point being one of a plurality of reference points on the bucket located at the first position, the plurality of reference points being preset on the bucket, the second reference point being one of the plurality of reference points on the bucket located at the second position.

2. The work machine according to claim 1,
wherein the work machine includes a selection switch for selecting any one of the plurality of reference points, and
wherein the controller is configured to select the first reference point from the plurality of reference points on the bucket located at the first position, and select the second reference point from the plurality of reference points on the bucket located at the second position, according to an operation of the selection switch.

3. The work machine according to claim 1,
wherein the first reference point and the second reference point are reference points located on a plane that is the farthest plane from a swing center of the upper swing structure among a plurality of planes each of which passes, in a state of being perpendicular to the ground contact surface, through one of the plurality of reference points on the bucket located at the first position and one of the plurality of reference points on the bucket located at the second position.

4. The work machine according to claim 1, wherein the controller is configured to:

compute a plurality of planes each of which passes through one of the plurality of reference points on the bucket located at the first position and one of the plurality of reference points on the bucket located at the second position and is perpendicular to the ground contact surface, and set, as the boundary surface of the entry-prohibited area, a plane that is the farthest plane from a swing center of the upper swing structure among the computed planes.

5. The work machine according to claim 1, wherein the plurality of reference points include a point located at a left end of a claw tip of the bucket and a point located at a right end of the claw tip of the bucket.

6. The work machine according to claim 1, wherein the controller is configured to reset the setting of the first position in a case where the lower track structure travels during a period of time from the setting of the first position to the setting of the second position.

* * * * *